US007832052B2

(12) United States Patent
Vrielink

(10) Patent No.: US 7,832,052 B2
(45) Date of Patent: Nov. 16, 2010

(54) DRAPERY MOTOR REMOTE ACTIVATION BY MANUAL DRAPERY PULL

(76) Inventor: Gerrit Jan Vrielink, 1700 N. Cheyenne Dr., Richardson, TX (US) 75080

( * ) Notice: Subject to any disclaimer, the term of this patent is extended or adjusted under 35 U.S.C. 154(b) by 107 days.

(21) Appl. No.: 11/752,066

(22) Filed: May 22, 2007

(65) Prior Publication Data

US 2008/0289778 A1 Nov. 27, 2008

(51) Int. Cl.
*A47H 15/00* (2006.01)

(52) U.S. Cl. ..... 16/87.4 R; 16/93 D; 16/95 R; 160/345

(58) Field of Classification Search ..... 16/87 R, 16/87.4 R, 90, 91, 93 R, 95 R, 96 R, 107, 16/101, 102, 105, 93 D, 87.2; 49/409–411, 49/324–326, 332, 330, 347–349, 352, 32, 49/139, 140; 160/330–332, 344, 124, 345–347, 160/126; 388/935; 341/173, 176; 318/280, 318/282, 445, 432–434
See application file for complete search history.

(56) References Cited

U.S. PATENT DOCUMENTS 4,881,588 A 11/1989 Madsen
6,024,156 A * 2/2000 Chu ..... 160/331
6,085,826 A * 7/2000 Maesaki ..... 160/345
6,178,699 B1 * 1/2001 Kawanobe et al. ..... 49/360
6,598,652 B1 * 7/2003 Montesinos Alonso ..... 160/331
6,624,605 B1 * 9/2003 Powder et al. ..... 318/445
6,637,494 B1 10/2003 Nabeta
6,886,218 B2 * 5/2005 ter Braak ..... 16/87 R
7,406,377 B2 * 7/2008 Shiga ..... 701/49
2004/0074046 A1 * 4/2004 Mimnaugh ..... 16/96 R
2004/0095268 A1 * 5/2004 Miyazaki ..... 341/176
2006/0162877 A1 7/2006 Chou
2006/0227030 A1 * 10/2006 Clifford et al. ..... 341/176
2007/0018595 A1 * 1/2007 Bejean et al. ..... 318/280
2007/0039700 A1 * 2/2007 Gu ..... 160/331
2008/0178529 A1 * 7/2008 Yoshida et al. ..... 49/352

* cited by examiner

*Primary Examiner*—Victor Batson
*Assistant Examiner*—Emily M Morgan
(74) *Attorney, Agent, or Firm*—Shaukat A. Karjeker

(57) ABSTRACT

A drapery master carrier for a drapery electric drive system is provided having a built-in wireless transmitter and a sensor to determine whether a manual pull is being applied to the drapes. The sensor is operatively connected to or incorporated into the wireless transmitter such that sensing by the sensor of a manual pull applied to the drapes will activate the wireless transmitter to transmit a signal to a motor drive controller receiver to drive the motor.

17 Claims, 10 Drawing Sheets

DRAPERY MOTOR REMOTE ACTIVATION BY MANUAL DRAPERY PULL

FIELD OF THE INVENTION

The present invention relates to the activation of motorized drapery systems. In particular, the present invention provides the ability to automatically start the motorized opening or closing operation of the draperies by activating motor operation by means of a radio frequency (RF), infrared (IR) or other wireless remote signal emitted from a transmitter incorporated in the master carrier assembly, the remote signal being initiated by a manual pull on the drapes.

BACKGROUND

Drapery support systems that permit opening and closing of the draperies are well known. Such systems commonly consist of an aluminum, steel or plastic headrail that contains a series of rollers or sliding carriers. These carriers have drapery fabric or material connected to them by some form of a drapery hook or other means. Depending on the form of pleating, these carriers are spaced at approximately three inches. Also depending on the pleating system, the individual carriers may or may not be directly connected to each other. In the most common form they are indirectly connected by means of the suspended drapery fabric. A lead carrier or master carrier is normally connected to the foremost end of the drapery fabric.

The master carrier is most commonly attached to a drive cord that is guided inside the metal or aluminum headrail, between the side walls of the headrail. At each end of the headrail, the drive cord is normally guided through a free-wheel pulley at the non-drive end and through a drive pulley at the drive end. In its most common manually operable form, the drive cord is guided down vertically at the drive end where it loops down. By pulling one end of the looped down cord, the drapery will be closed; by pulling the other end, the drapery will be opened. Some drapery systems do not have a drive cord, but are operated by pulling a wand that is connected to the drive carrier. Instead of being actuated by a cord, some systems are driven by a steel wire or a belt.

Drapery systems may consist of one panel which opens towards one end only (one-way opening), or they may consist of two panels which then close towards the center and open by pulling the panels each to one end (center opening). In the case of very long windows, more than two panels may be hung from the same headrail, for simultaneous opening with a single drive motor.

To avoid excessive wear and tear of drapery fabrics, it is generally not recommended to open and close drapery panels by pulling on the drapery fabrics or materials themselves. Especially on cord actuated systems, the required force to pull a drapery open or closed by means of pulling the fabric instead of the cord may require considerable force and result in damage to the fabric or the system.

Motor powered drapery systems are known in either a direct drive version or an indirect drive version. In a direct drive version, the motor is directly connected to the headrail and the rotation power is transmitted to the drive cord, wire, chain or belt via a gear mechanism. An indirect drive version includes cord-driven motors that are normally mounted at some distance below the drapery headrail and have a vertical loop of the drive cord that extends below the headrail, guided through a pulley attached to the motor. Cord drive motors are usually hard to conceal, tend to require more maintenance for cord adjustments, and are usually less powerful than direct drive motors. Cord drive motors are more commonly used to retrofit manual cord-driven drapery systems.

Direct drive drapery motors are normally outfitted with a pulley or sprocket that provides traction to rotate the drive cord, belt, chain or wire. The master carrier of the drapery system is normally attached to the drive belt, cord or wire by means of a fixed connection.

Because direct drive motors are normally fully concealed behind the drapery fabric, it is often not apparent to a user that a drapery system is motorized. An unsuspecting user may be tempted to start pulling on the fabric to open or close a drape which will require rotation of the motor. However, since such rotation is prevented by the direct drive connection, this could create damage to the mechanism if excessive force were applied by the user.

To prevent such damage from occurring by inadvertent manual operation by a user, mechanical disengager mechanisms can permit easy movement of the drapery fabric without damage to the electric drive system. Current methods achieve this either by disconnecting the belt, wire, chain or cord from the electric drive mechanism of the motor by means of a mechanical or an electromagnetic disconnect or by means of a mechanical disconnect of the master carrier. A disadvantage of the disconnect method is that after disconnecting, the drapery cannot be moved under electrical power until the drive is reconnected.

A further current method is to manually traverse the drapery fabric over a short distance, thus pulling on the belt, wire, chain or cord drive and hence the motor gear drive. This creates an induction current in the motor which is electronically sensed and in turn will switch on the electrical power to the motor, thus activating the motor to move the drapery to the open or closed position. The disadvantage of this method is the requirement for the user to create a pulling force in a horizontal direction which, especially in heavier draperies, may be cumbersome. A further disadvantage is that the method requires that the motors be equipped with the specific current sensing technology. This therefore requires specially designed motors.

The electromagnetic shaft disconnect consists of a motor shaft that connects the drive shaft of the direct drive motor with a cord drive pulley. By applying power to the motor, magnets in the electromagnetic disconnect get actuated and pull the shaft end into a matching opening of the drive pulley, thus establishing a fixed connection between motor and drive wire, belt, chain, or cord. The disadvantage of this system is that it is most commonly operated by drive motors that are started and stopped by means of current sensing. Such motor require considerable torque surges and as a consequence tend to be noisy.

Prior art master carrier disconnects most commonly exist in two versions. The first version consists of a spring loaded nipple attached to the traveling master carrier which matches with a depression in a connector block mounted against the inside of a perforated drive belt. Because of space considerations, the microdimensions make the system extremely sensitive to wear and most commonly permit only very small drapery weight loads.

The other commonly known version consists of a master carrier featuring a single levered arm provided with one single multipurpose spring. By pulling the far end of the drapery downward, the levered arm frees the locking pin from the portion of the master carrier that is connected to the drive belt. This way the drapery fabric can be moved by hand.

The disadvantage of this system is that there is only one spring to handle both the drapery load function and the locking spring function. This requires that the spring action be strong enough to carry the drapery load, keep it in position and pull the arm back into position, but not so strong that it would prevent the locking pin from sliding back into its connector. The use of a single spring for this dual purpose severely limits the maximum allowable load on the arm. Currently this is commonly limited to a maximum of 0.5 kg vertical load.

The load limitation caused by the single arm and single spring concept of the prior art places severe limitations on the motorized drapery system. In many instances, motorized systems are used to eliminate the need for manual operation of especially large and heavy drapery systems. Weight limitations impose severe restrictions on the range of applications. Furthermore, the range between the drapery load and the maximum allowable weight due to the spring capacity can easily be exceeded, which would cause the load to lower the levered arm and free the connection between master carrier and drive belt. This would result in a malfunction of the motorized system when power is applied.

OBJECTS OF THE INVENTION

It is therefore an object of the invention to overcome at least some of the foregoing disadvantages of prior art systems.

It is a further object of the present invention to provide an apparatus and method to remotely initiate the operation of the motor drive by means of sensing a manual pull on the drapes and transmitting a signal, preferably by radio frequency (RF), infrared (IR) or other wireless transmission, to a motor controller receiver to initiate the motor drive.

This proposed invention introduces a unique new concept that eliminates the need to mechanically disconnect the master carrier from the rotating belt, cord or wire that drives the traversing function in order to prevent damage to the electric drive system by attempted manual pulling on the drapes. It further permits application to a wider scope of standard motors with either built-in or external wireless receivers. The invention can employ an RF transmitter, IR or other wireless transmitter in or attached to the master carrier that is activated (switched on) by a slight manual pull at the drapery fabric. The transmitter emits a signal that is received by an internal or external wireless receiver operatively connected to the motor such that it electronically switches the motor on to drive the drapes. In one embodiment, the same wireless receiver that is already used in conjunction with a wireless remote control (handheld or otherwise) for the drapery motor can be used, if the drapery system already includes such a wireless remote control system. The start of the motor will, at least, alert the user to the existence of the electric motor drive system and thus prevent damage to the electric drive system, without the need to mechanically disconnect the master carrier from the rotating belt, cord or wire that drives drapes. The sensor can also be configured to sense the direction of pull on the drapes, and cause transmission of a signal to drive the motor in the same direction as the manual pull. The motor can also be provided with preset limit switches that ensure the exact end positions of open and closed position. A mechanical disengager can also optionally be included.

SUMMARY OF THE INVENTION

In accordance with one embodiment, a drapery master carrier for a drapery electric drive system can be provided comprising a wireless transmitter and a sensor to determine whether a manual pull is being applied to the drapes, said sensor being operatively connected to, or incorporated into, said wireless transmitter such that sensing of a manual pull applied to the drapes by the sensor will activate the wireless transmitter to transmit a signal to a motor drive controller receiver to drive the motor.

BRIEF DESCRIPTION OF THE DRAWINGS

The foregoing and other objects, features and advantages will be apparent to those skilled in the art upon review of the detailed description herein, with reference to the drawings, in which.

DETAILED DESCRIPTION

Figure 1:
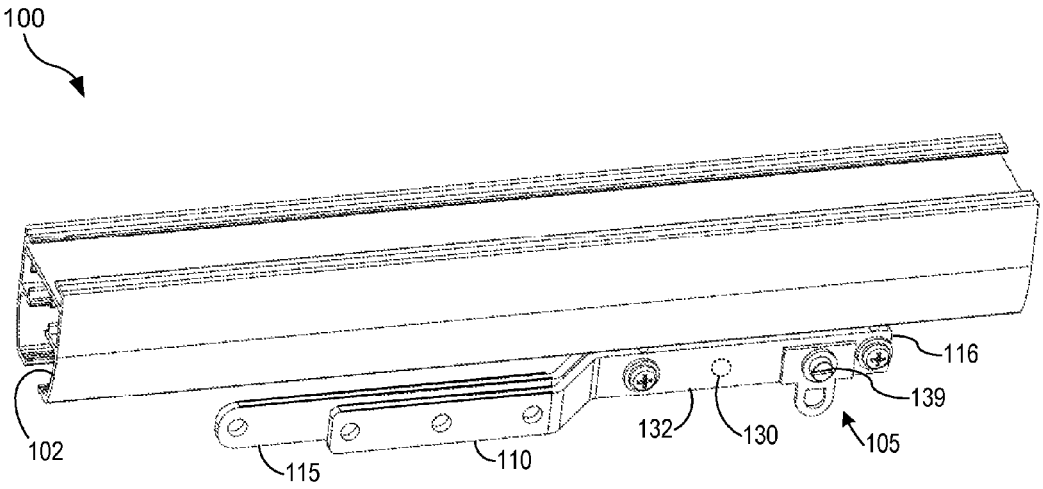
FIG. 1 depicts an orthogonal view, from the left side and above, of a disengageable master carrier assembly in accordance with an embodiment of the invention, mounted onto a drapery.
Figure 2:
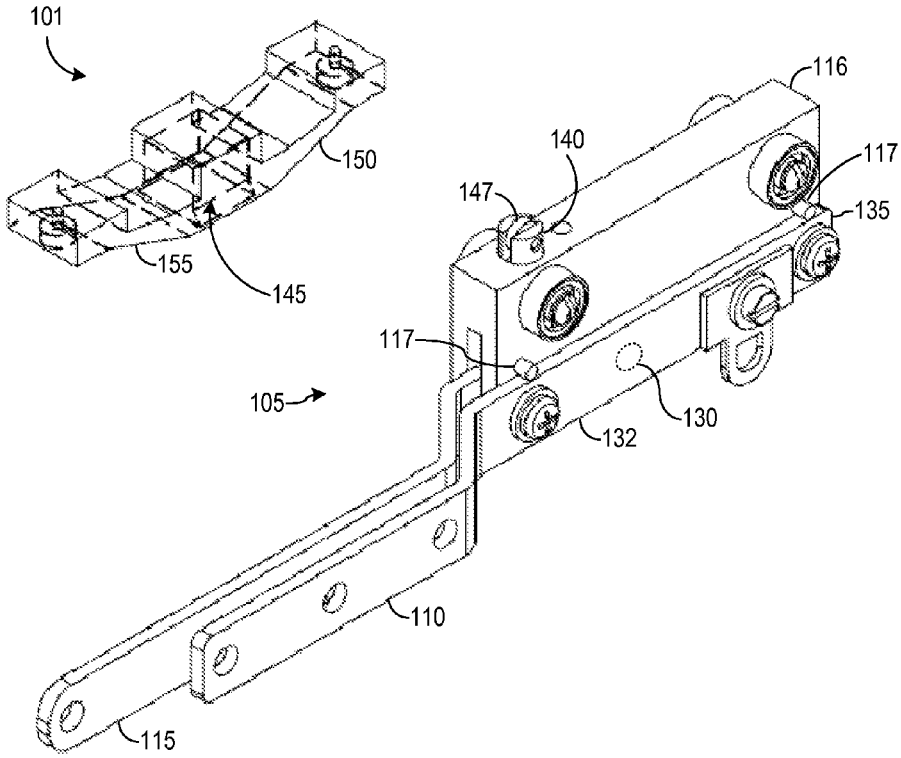
FIG. 2 depicts an orthogonal view, from the left side and above, of a disengageable master carrier assembly, with the locking block section separated from the master carrier block section.
Figure 3:
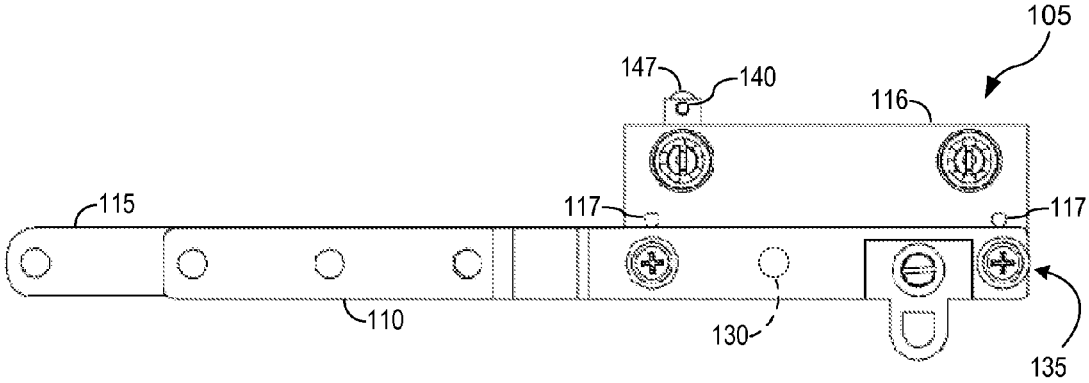
FIG. 3 depicts a front elevation view of the master carrier block.

Turning now to the drawings in detail, and initially to FIGS. 1, 2 and 3 thereof, one embodiment of a master carrier drive block assembly 100 with a mechanical disengager and no RF or IR transmitter. Master carrier block assembly 100, which can be slideably disposed inside headrail 102, is made up of two main components: the locking block section 101 that is connected to the drive belt (not shown) and the master carrier block section 105 that is attached to the forward end of the fabric of the drapes (not shown).

Turning now to FIGS. 4A-4C and 5A-5D, an elevation view of the master carrier block wherein the spring function required to carry the drapery load is separated from the spring function of the locking mechanism that disengageably connects the master carrier block 105 to the locking block section 101 connected to the drive belt (not shown). In the embodiment depicted, the invention further uses dual metal arms 110 and 115 mounted to master carrier block body 116. One of these, shorter arm 110, can be mounted to the body 116 in a non-movable and non-spring-loaded manner to the master carrier block 105. This shorter arm 110 will carry all of the drapery weight supported by the master carrier block body 116 except for the last inch or so of the fabric at the end. Because the shorter arm 110 need not be movable or spring-mounted relative to the carrier block body 116, it is not subject to weight limitation, providing it is properly designed for the drapery load.

Figure 5C:
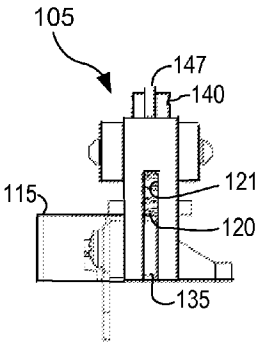
FIG. 5C depicts a rear end elevation view of the master carrier block, in the engaged condition.
Figure 5D:
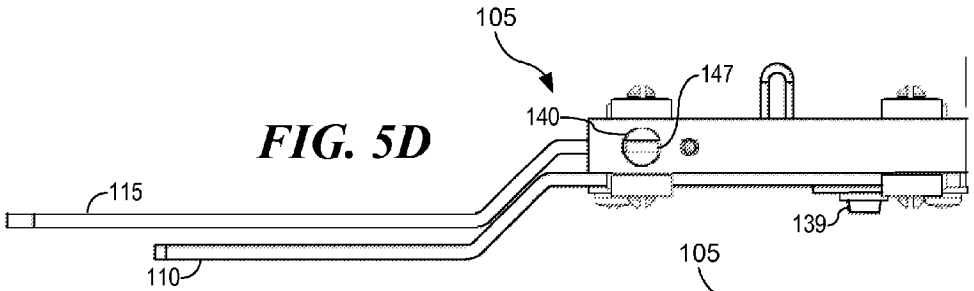
FIG. 5D depicts a plan view of the master carrier block, in the engaged condition.
Figure 5B:
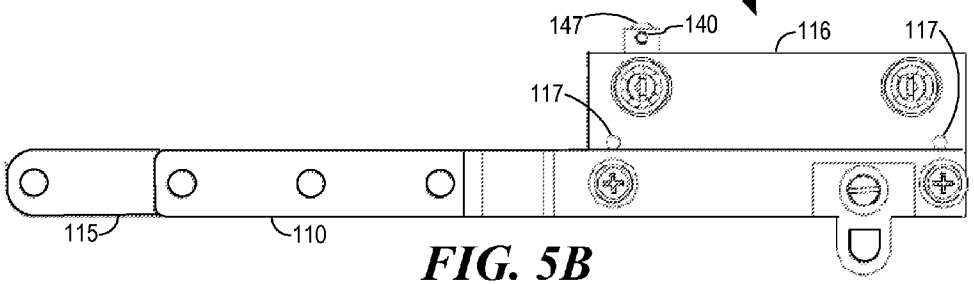
FIG. 5B depicts a front elevation view of the master carrier block, in the engaged condition.
Figure 5A:
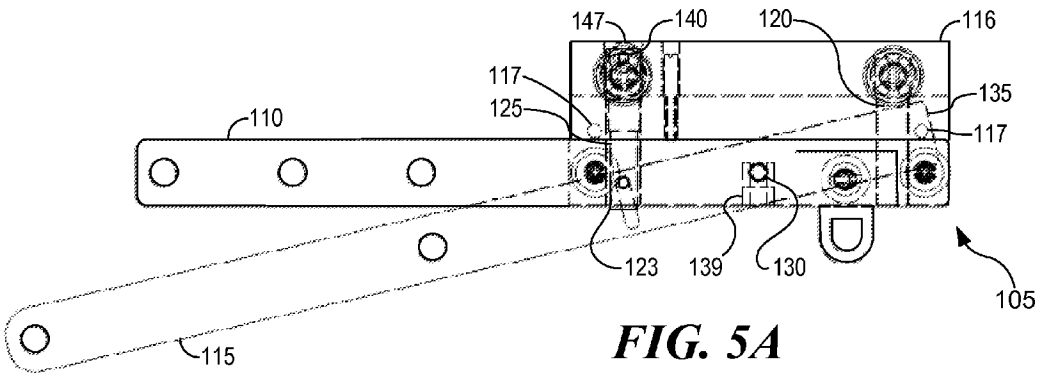
FIG. 5A depicts a front elevation view of the master carrier block assembly, partly in phantom, with the longer arm in the disengaged down condition caused by manually pulling the drapery front edge.

As can be seen in FIGS. 5A and 5D, unlike prior art system, the engagement/disengagement function in the present invention is accomplished by using two separate springs 120 and 125 in master carrier block body 116. The longer arm 115 supports the leading edge of the drapery fabric (not shown). The longer arm 115 can protrude about one inch beyond the fixed shorter arm 110 and thus only has to support approximately the load of this last one-inch or so wide strip of fabric.

Longer arm 115 is pivoted about pivot 130 and held against the weight of the drapery fabric by a firm load-carrying spring 120 disposed in a cylinder 121 in the master carrier block 105, pressing upwardly on the rear end 135 of longer arm 115, behind the pivot 130 for the longer arm 115. Longer arm 115 could also be held in place by positioning spring 120 forward of the pivot 130, so it pressed upwardly on the bottom of the front 132 of longer arm 115. In the embodiment depicted, the longer arm 115 can be approximately parallel to the headrail 102, the position being determined by stops 117 on the master carrier block body 116, although a parallel position of the longer arm 115 is not mandatory.

The resilience of spring 120 can be adjustable by means of a set screw 139 for various vertical load carrying capacities. In this way, the disengaging force required can be adjusted depending on the weight of the drapery fabric selected. Furthermore, different strength springs may be used to increase or decrease load capacity further if necessary for different draperies or headrail designs.

Figure 4A:
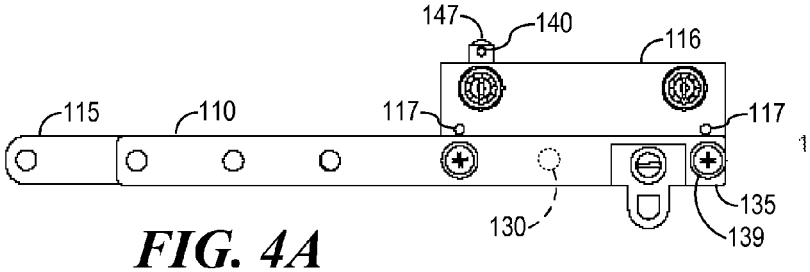
FIG. 4A depicts a front elevation view of the master carrier block, in the engaged condition.
Figure 6A:
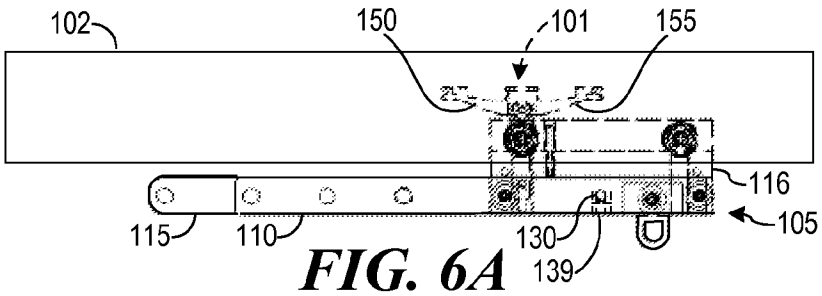
FIG. 6A depicts a front elevation view of the disengageable master carrier assembly, partly in phantom, mounted onto a headrail, in the normal operating engaged condition.

Referring to FIGS. 4A, 5B and 6A, the master carrier block assembly 100 is depicted with the longer arm 115 in its normal "up" position, with the pin 140 extended, as it would be with the locking block section 101 engaged. A locking pin 140 can hold the master carrier block 105 to the drapery drive belt locking block section 101 by extending into a pocket 145 in the middle locking block section 101. When engaged in this manner, this locking pin is normally held in place in the pocket by a separate, very light locking spring 125 positioned in pocket 145 in the master carrier block 105, squeezed upwardly against the bottom of the pin 140 by the rear 135 of pivoted longer arm 115 pressing on the bottom of the spring 125. Only light vertical force upward on the pin 140 from this light spring 125 is required to keep the pin 140 up and engaged in pocket 145.

Figure 4B:
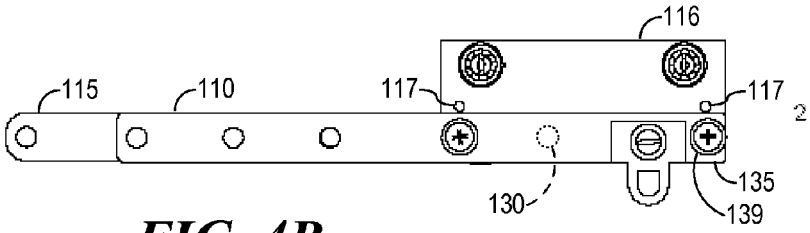
FIG. 4B depicts a front elevation view of the master carrier block, in the disengaged condition with the longer arm in the normal "up" condition, just prior to re-engagement into the locking block section.
Figure 4C:
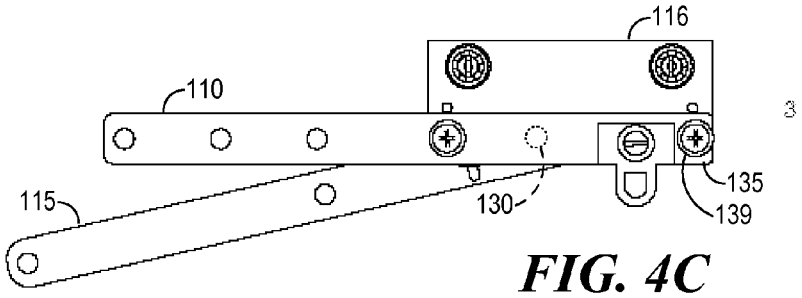
FIG. 4C depicts a front elevation view of the master carrier block, in the disengaged condition, with the longer arm in the disengaged down condition caused by manually pulling the drapery front edge.
Figure 6B:
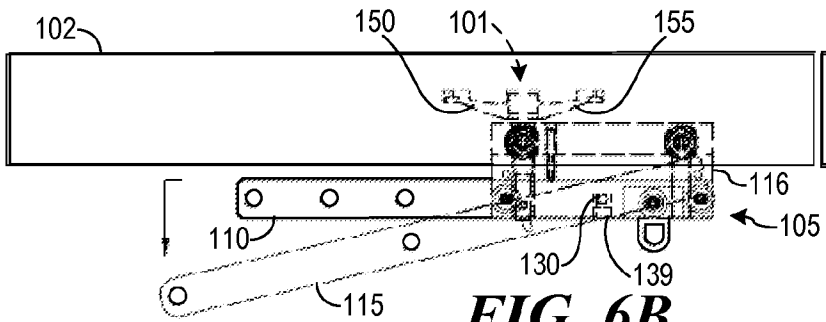
FIG. 6B depicts a front elevation view of the disengageable master carrier assembly, partly in phantom, mounted onto a headrail, with the longer arm in the disengaged down condition caused by manually pulling the drapery front edge, prior to separation of the locking block section.
Figure 6C:
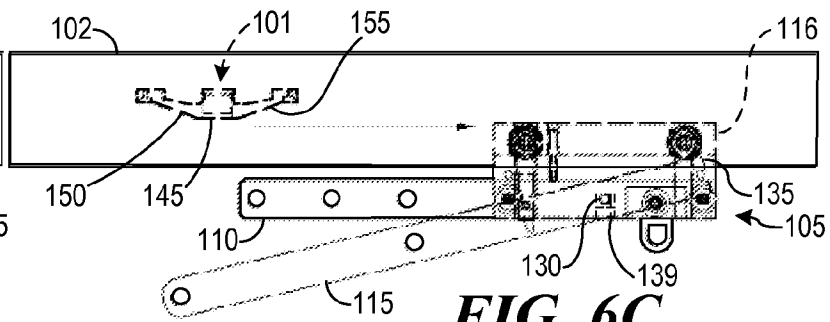
FIG. 6C depicts a front elevation view of the disengageable master carrier assembly, partly in phantom, mounted onto a headrail, with the longer arm in the disengaged down condition caused by manually pulling the drapery front edge, after separation of the locking block section.

As depicted in FIGS. 4C, 5A and 6B, a manual pull on the front of the drapery fabric will cause the extended end of the longer arm 115 to pull down. This allows the light spring 125 on a pin 140 to relax and lower, thus lowering and disengaging the pin 140 from the pocket 145 of drapery belt locking block section 101. This instantaneously frees the connection between master carrier block 105 and the locking block section 101 to which the drive cord, belt, wire, chain or the like is connected, thus permitting smooth manual opening or closing of the draperies without rotation of the drive belt, cord, wire, or chain, or damage to other parts of the electric drive system, as depicted in FIG. 6C.

Figure 6D:
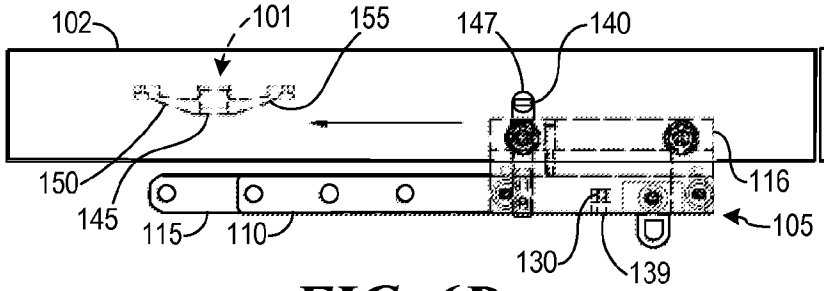
FIG. 6D depicts a front elevation view of the disengageable master carrier assembly, partly in phantom, mounted onto a headrail, with the longer arm in the up condition, prior to re-engagement of the locking block section.
Figure 6E:
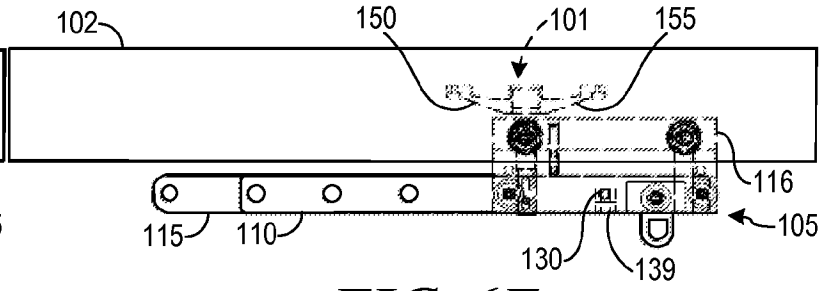
FIG. 6E depicts a front elevation view of the disengageable master carrier assembly, partly in phantom, mounted onto a headrail, with the longer arm in the up condition, prior to re-engagement of the locking block section.

As depicted in FIGS. 4B, 6D and 6E, when it is desired to return to motor driving of the draperies, activation of the drive motor will automatically guide the sloped forward (or back) entrance ramps 150 and 155 to the locking block section 101 toward the master carrier block 105. As depicted in FIGS. 4B and 6D, with the longer arm 115 in its normal "up" position (i.e., when the drapery is not being manually pulled) the light spring tension of the second light spring 125 can allow the pin 140 to retract into its cylinder 121, even while arm 115 is "up." Only light pressure on the top of pin 140 is required to push the pin 140 down to the disengaged position, with the longer arm 115 "up," as would be the case during the process of re-engagement of the locking block section 101. Then, as depicted in FIG. 6E, when pocket 145 aligns with pin 140, the spring 125 will extend the pin 140 into the pocket 145, reestablishing the positive traction of the electric motor drive.

As depicted in FIGS. 1, 2 and 3, for example, the locking pin 140 can be provided with a rotatable wheel 147 at its anterior end that can ride up the sloped surfaces of the entrance ramps 150 and/or 155 of the locking block section 101 attached to the drive belt, cord, wire, chain, etc. (not shown). Rotatable wheel 147 will ensure extremely smooth return of the pin 140 into the pocket 145 of the locking block section 101 to reconnect the master carrier block 105 to the locking block section 101.

The pre-set end stops of the electric drive system are not affected by the manual operation because the position is determined by the rotation of the drive belt, cord, wire, or chain. This ensures ongoing accurate opening and stacking position of the draperies and maintaining of the final preset desired drapery end position. These end positions may be preset and controlled by Silent Stop™ (a trademark for a BTX, Inc. product for controlling the drapery stopping position of an electric motor driven drapery) or by other means.

Figure 7:
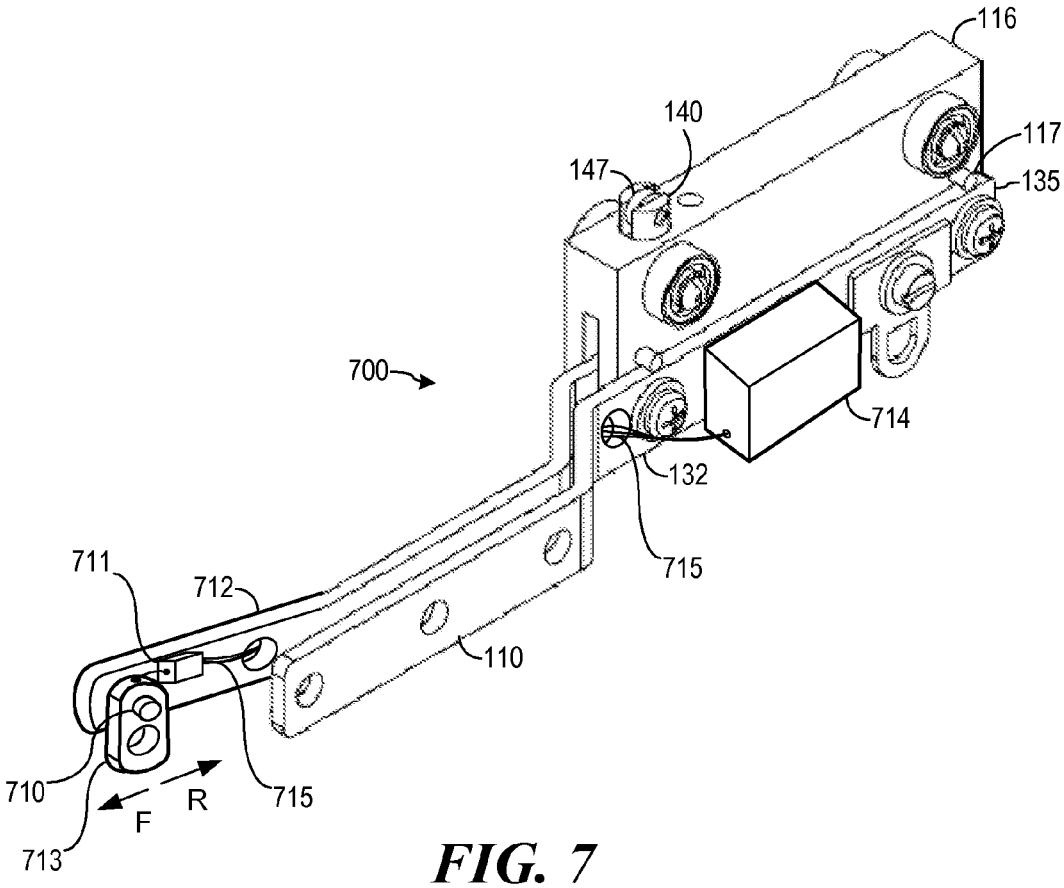
FIG. 7 depicts an orthogonal view, from the left side and above, of a disengageable master carrier assembly having a pivotable sensor and a built-in radio frequency or IR transmitter assembly.

Turning now to FIG. 7, a novel concept that eliminates the need to move the fabric sideways by hand or to exert a manual downward pulling force of sufficient magnitude to mechanically disconnect the master carrier from the rotating belt, cord, chain or wire that drives the traversing function is depicted. It further permits application to a wider scope of standard motors with either built-in or external RF or IR receivers.

As shown in FIG. 7, a built-in RF or IR transmitter can be provided on a master carrier assembly 700 that is activated (switched on) by a slight manual pull at the drapery fabric. In one embodiment, the sensor element 711 can be sensitive to whether the drapery is being pulled in either the forward (F) or reverse (R) direction. In this embodiment, the arm 712 can be bent up somewhat and a downwardly hanging movable member 713 provided that is pivoted to the end of arm 712 by means of pivot 710. The swinging forward (or back) of swingable member 713 of sensor assembly activates one or the other of the contacts of the sensor, which can be a mechanical or non-mechanical switch 711. Switch 711 is operably connected to radio frequency transmitter or IR 714, which is mounted to the master carrier 700, by means of wires 715. Wires 715 can include a power wire, a forward contact wire and a reverse contact wire. A slight manual pull on the drapes in a forward direction will rock swingable member forward, closing the forward contact in switch 711 to the power wire. A slight manual pull on the drapes in a reverse direction will rock swingable member backward, closing the reverse contact of switch 711 to the power wire. The respective signals from the forward or reverse wires will be received by radio frequency or IR transmitter 714, which can be powered by a battery or other convenient means (not shown), causing the transmitter to send a signal to the motor remote controller radio frequency or IR receiver (not shown) to rotate in either a forward or reverse direction, the same as if the motor controller had been activated by the power switch or remote control. The motor is provided with preset limit switches that ensure the exact end positions of open and closed position. Although it is desirable for the switch 711 to be able to sense the forward or reverse direction of the manual pull, and to transmit a signal to drive the motor in the same forward or reverse direction, this is not necessary for the invention, since simply having the motor start will alert the user that the drapery system is motorized, which will itself help to prevent damage to it by attempted manual opening or closing.

In this embodiment, the arm 712 can employ a downwardly hanging sensor assembly 711 including a movable member 713 that is pivoted to the end of arm 712 by means of pivot 710. The swinging forward (or back) of swingable member 713 of sensor assembly activates one or the other of the contacts of switch 711. Switch 711 is operably connected to radio frequency transmitter or IR 714, which is mounted to the master carrier 700 by means of wires 715.

Figure 8:
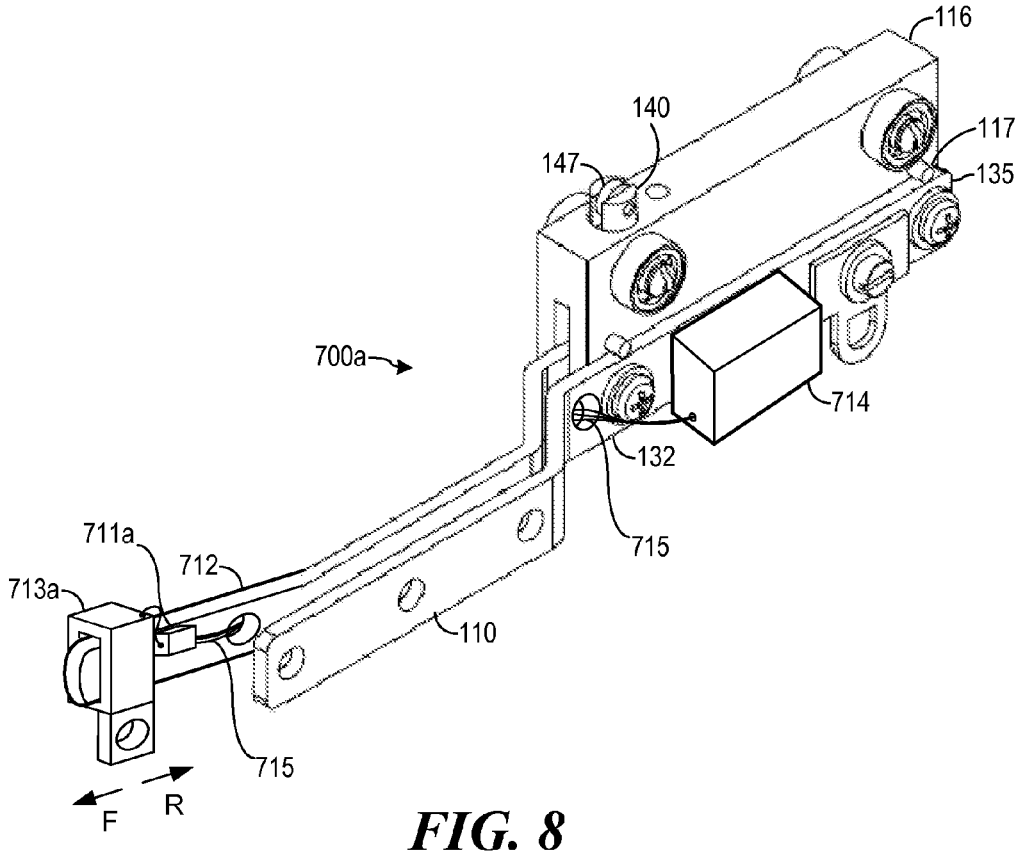
FIG. 8 depicts an orthogonal view, from the left side and above, of a disengageable master carrier assembly having a slidable sensor and a built-in radio frequency or IR transmitter assembly.
Figure 9:
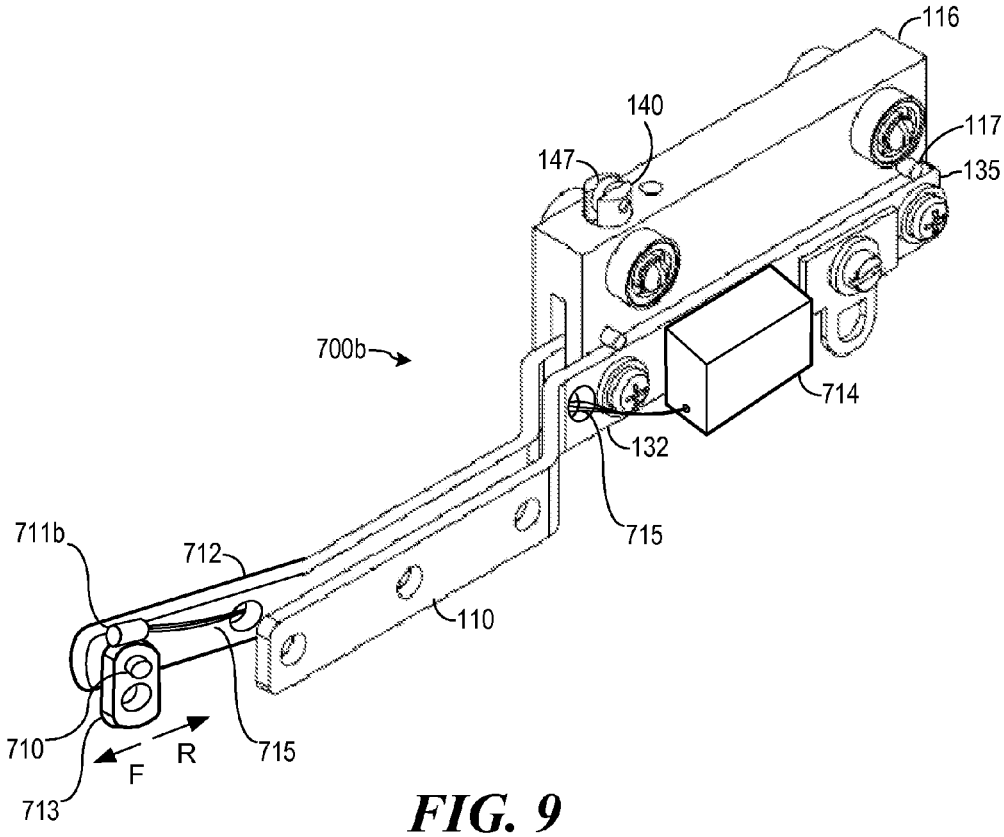
FIG. 9 depicts an orthogonal view, from the left side and above, of a disengageable master carrier assembly having stress sensor and a built-in radio frequency or IR transmitter assembly.

As depicted in FIG. 8, the sensor assembly need not include a swingable member. Instead, the sensor assembly 714*a* can include a slidable member 713*a* to actuate the switch 711*a*. Furthermore, as depicted in FIG. 9, a sensor assembly can include a sensor element having no mechanical switch, such as a Hall effect switch or a stress sensor 711*b* for sensing the manual pull on the drapes and delivering a signal corresponding to this to the RF or IR transmitter 714. Of course, many other variations of sensing elements for sensing the manual pull on the drapes are also possible and within the scope of the present invention.

Figure 10:
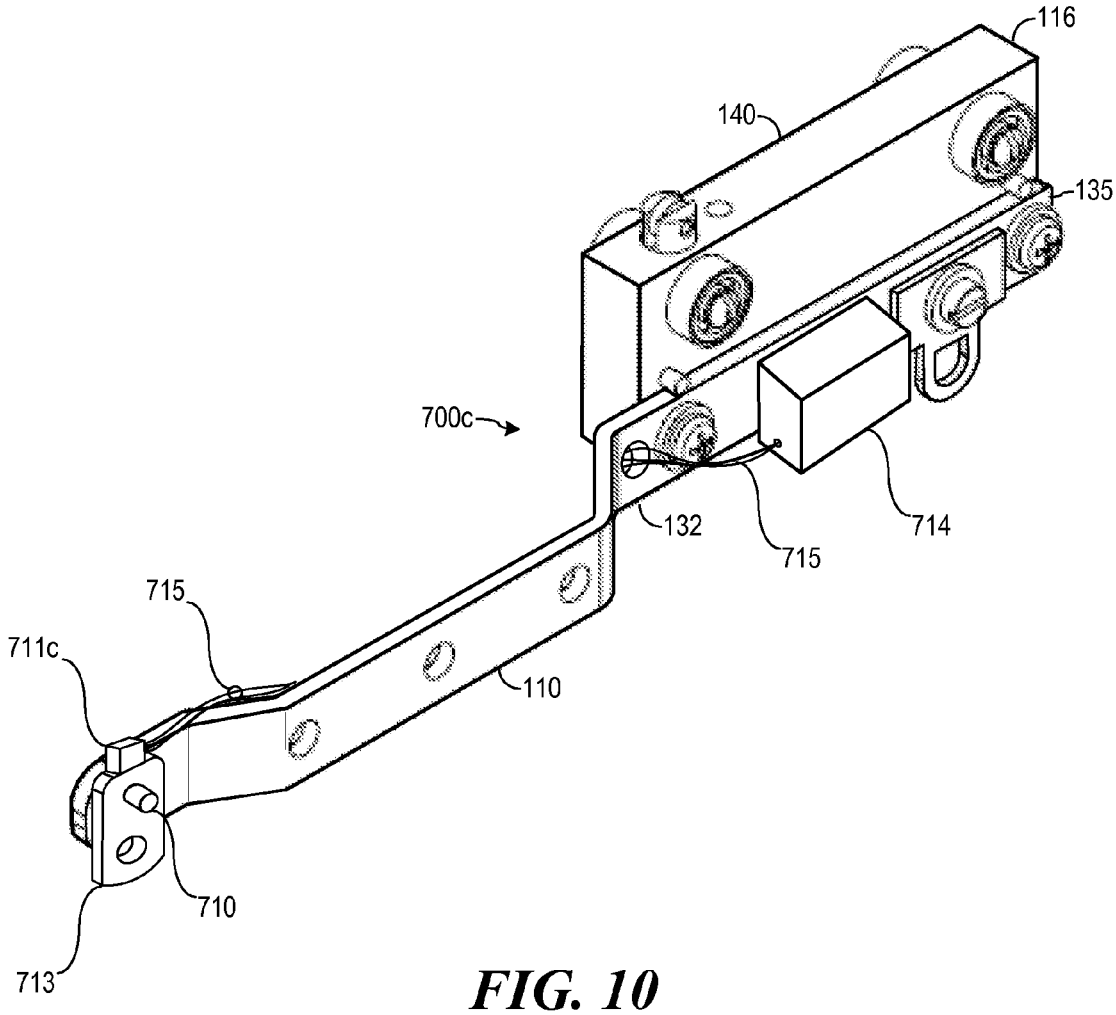
FIG. 10 depicts an orthogonal view, from the left side and above, of a master carrier assembly having no disengager mechanism and including a pivotable sensor and a built-in radio frequency or IR transmitter assembly.

FIG. 10 depicts a master carrier 700*c* including a sensor element 711*c* (which can be of any type) and RF or IR transmitter 714 but no disengager assembly. Although separate use of a disengager assembly can, in some applications, help to prevent or minimize damage to the drapery motor drive assembly in instances where the RF or IR transmitter 714 is disabled for some reason (such as, if the battery is dead), this redundancy and the added costs associated with it may not be not necessary or desirable in all applications.

Figure 11:
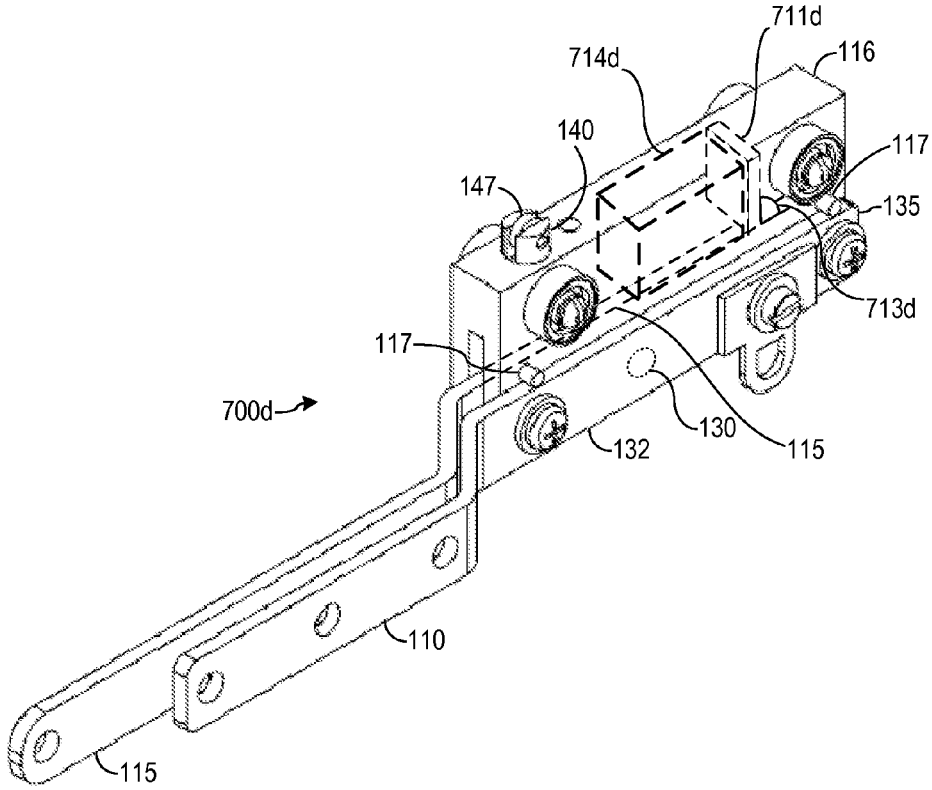
FIG. 11 depicts an orthogonal view, from the left side and above, of a disengageable master carrier assembly having a pivotable sensor and a built-in radio frequency or IR transmitter mounted in the housing of the master carrier assembly.

FIG. 11 depicts a master carrier assembly 700*d* of the present invention having a sensor 711*d* with an actuator member 713*d* and a radio frequency or IR transmitter assembly 714*d* mounted in the housing of the master carrier assembly. In this case, no separate wires 715 are required between the sensor and the transmitter assembly.

Figure 12:
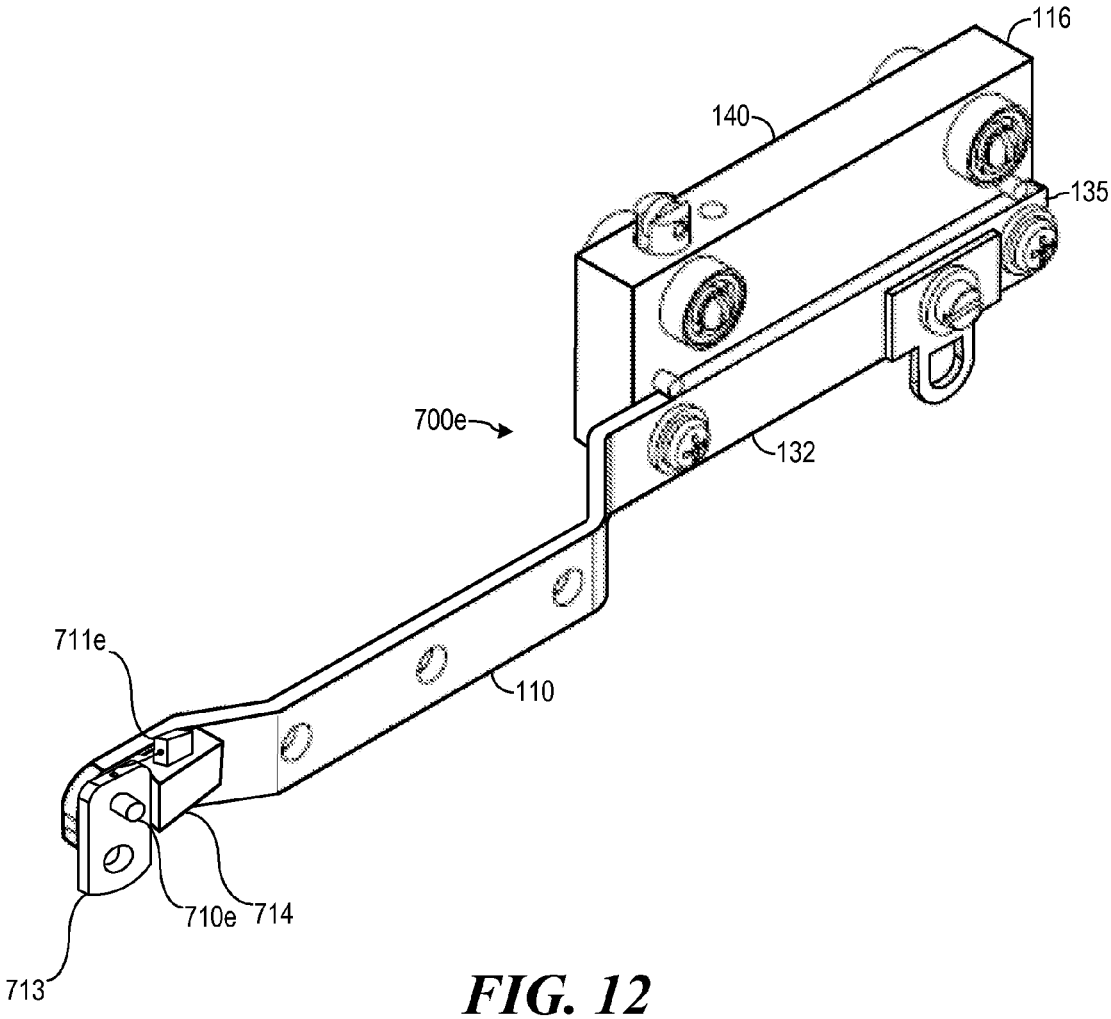
FIG. 12 depicts an orthogonal view, from the left side and above, of a master carrier assembly having both a pivotable sensor and a built-in radio or IR frequency transmitter mounted on the arm of the master carrier assembly.

FIG. 12 depicts a master carrier assembly 700*e* which has both a pivotable arm 711*e* with a sensor 711*e* and a built-in radio frequency or IR transmitter assembly 714*e* mounted on the arm 110 of the master carrier assembly. Also in this case, no separate wires 715 are required between the sensor and the transmitter assembly.

It should be noted that, although the manual pull initiated radio frequency or IR transmitter assembly described above is shown as incorporated into a master carrier assembly having a disengaging mechanism, it is to be noted that the manual pull initiated radio frequency or IR transmitter assembly does not require any particular type of disengaging mechanism. Furthermore, the manual pull initiated radio frequency transmitter or IR assembly does not require any separate disengaging mechanism, nor does it preclude the use of one.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It is therefore contemplated that the claims will cover any such modifications or embodiments that fall within the true scope and spirit of the invention.

What is claimed is:

1. A drapery master carrier for a drapery electric drive system, said master carrier comprising:

a master carrier body;

a sensor mounted to the master carrier body, the sensor having a laterally moving movable member extending in contact with drapes to detect motion of the drapes when a manual pull force on the drapes causes detectable motion of the drapes, the sensor comprising a switch, the switch adopting a first position when the sensing element detects forward motion of the drapes, and the switch adopting a second position when the sensing element detects rearward motion of the drapes; and a transmitter mounted to the master carrier body, the transmitter in communication with the switch and transmitting a signal to a motor drive controller receiver to drive a motor to move the master carrier in accordance with a sensor detected direction of motion.

2. The drapery master carrier defined in claim 1, wherein the movable member is a pivotable member.

3. The drapery master carrier defined in claim 1, wherein the movable member is a slidable member.

4. The drapery master carrier defined in claim 1, wherein the sensor and transmitter are integrated into one housing.

5. The drapery master carrier defined in claim 1, wherein the master carrier body includes an arm for carrying drapery.

6. The drapery master carrier defined in claim 5, wherein the movable member is disposed on the arm.

7. The drapery master carrier defined in claim 5, wherein the transmitter is disposed on the arm.

8. The drapery master carrier defined in claim 5, wherein both the movable member and the transmitter are disposed on the arm.

9. The drapery master carrier defined in claim 1, wherein the master carrier includes a housing.

10. The drapery master carrier defined in claim 9, wherein the transmitter is disposed in the housing of the master carrier.

11. The drapery master carrier defined in claim 9, wherein the transmitter is disposed externally to the housing of the master carrier.

12. The drapery master carrier defined in claim 9, wherein the sensor is disposed in the housing of the master carrier.

13. The drapery master carrier defined in claim 9, wherein the sensor is disposed externally to the housing of the master carrier.

14. The drapery master carrier defined in claim 1, wherein the master carrier further comprises a movable member connectable to a forward edge of the drapes, the movable member coupled to a load carrying spring, and locking spring.

15. The drapery master carrier defined in claim 1, wherein the transmitter is a wireless transmitter.

16. A drapery master carrier for an electric drapery drive system to open and close drapes, the master carrier comprising:

a master carrier body, the master carrier body comprising an arm extending from the master carrier body, the arm configured to support a portion of a drape;

a sensor mounted to the master carrier body, the sensor having a laterally moving movable member, the movable member detecting relative motion between (a) a portion of the drapes supported by the master carrier body and (b) the master carrier, when a pull force on the drapes causes detectable lateral drape motion; and a transmitter mounted to the master carrier body, the transmitter in communication with the sensor to receive signals indicating forward lateral or rearward lateral detected drape motion, the transmitter signaling a motor drive controller to move the master carrier in accordance with the detected drape motion.

17. A motor-driven drapery master carrier for an electric drive system that opens and closes drapes, the drapery master carrier comprising:

a sensor mounted to the drapery master carrier, the sensor having a laterally moving movable member, the movable member located to respond to a detectable forward lateral and rearward lateral vector of a pull force on a portion of drapes supported on the drapery master carrier; and a transmitter mounted to the drapery master carrier, the transmitter in communication with the sensor, the transmitter sending an activating signal to move the master carrier in a direction of the lateral vector of the pull force detected by the sensor.

* * * * *